US005435218A

United States Patent [19]

Martin

[11] Patent Number: 5,435,218

[45] Date of Patent: Jul. 25, 1995

[54] SLICING MACHINE

[75] Inventor: Mario Martin, Treviso, Italy

[73] Assignee: Comas S.p.A., Silea, Italy

[21] Appl. No.: 97,779

[22] Filed: Jul. 26, 1993

[30] Foreign Application Priority Data

Aug. 3, 1992 [IT] Italy ..... TO92A0671

[51] Int. Cl.[6] ..... A24B 7/00; B26D 7/06

[52] U.S. Cl. ..... 83/176; 83/278; 83/437; 83/468.6; 83/860; 83/931

[58] Field of Search ..... 83/176, 437, 467.1, 83/468.6, 639.1, 639.5, 697, 859, 860, 931, 278

[56] References Cited

U.S. PATENT DOCUMENTS 2,207,754 7/1940 Neary ..... 83/468.6
3,180,195 4/1965 Clark ..... 83/437 X
5,152,208 10/1992 Ruetschle et al. ..... 83/860 X

FOREIGN PATENT DOCUMENTS 0159836 10/1985 European Pat. Off. .
0511196 10/1992 European Pat. Off. .
1139419 11/1962 Germany .
58-81773 5/1983 Japan .
2246279 1/1992 United Kingdom .
WO-A-87/02868 5/1987 WIPO .

*Primary Examiner*—Eugenia Jones
*Attorney, Agent, or Firm*—Edward D. Manzo; Ted K. Ringsred

[57] ABSTRACT

A tobacco bale slicing machine having a support structure with an inlet opening for the insertion of a bale, and with an outlet portal. A conveyor transfers a bale from the inlet opening to the outlet portal in which there is a guillotine-like cutting device. A thrust device bears against the rear end surface of the bale to urge it towards and through the outlet portal in a controlled manner. The thrust device includes a motor-driven carriage disposed above the conveyor and has a thrust member mounted on an arm which moves between a raised and lowered position. When in a lowered, working position the thrust member can be brought to bear against the rear end surface of a bale carried by the conveyor in order to urge it toward the outlet portal in a controlled manner.

8 Claims, 6 Drawing Sheets

SLICING MACHINE

FIELD OF THE INVENTION

The present invention relates to a slicing machine, particularly for bales of tobacco.

SUMMARY OF THE INVENTION

The slicing machine according to the invention is characterized in that it comprises:

- a support structure with an inlet opening for the insertion of a bale, and with an outlet portal,
- a conveyor for transferring a bale from said inlet opening to the outlet portal,
- a guillotine-like cutting device associated with said outlet portal and comprising a cutting blade which is movable between a raised position in which it allows a bale carried by the conveyor to advance through the portal, and a lowered, cutting position,
- a thrust device movable in said structure, above the conveyor, and comprising a thrust member which can bear on the rear end surface of the bale carried by the conveyor in order to urge it towards the outlet portal in a controlled manner, and
- an abutment device associated with the outlet portal, downstream of the cutting device, and comprising a movable stop member which can assume a working position in which it defines a position where the bale advancing through the outlet portal in use is stopped at a predetermined distance from the path of the cutting blade, the distance corresponding to the desired thickness of the slices to be cut.

Further characteristics and advantages of the slicing machine according to the invention will become clear from the following detailed description given with reference to the appended drawings, provided purely by way of non-limiting example.

BRIEF DESCRIPTION OF THE DRAWINGS

In describing the preferred embodiment, reference is made to the accompanying drawings wherein.

DESCRIPTION OF THE PREFERRED EMBODIMENT

Figure 1:
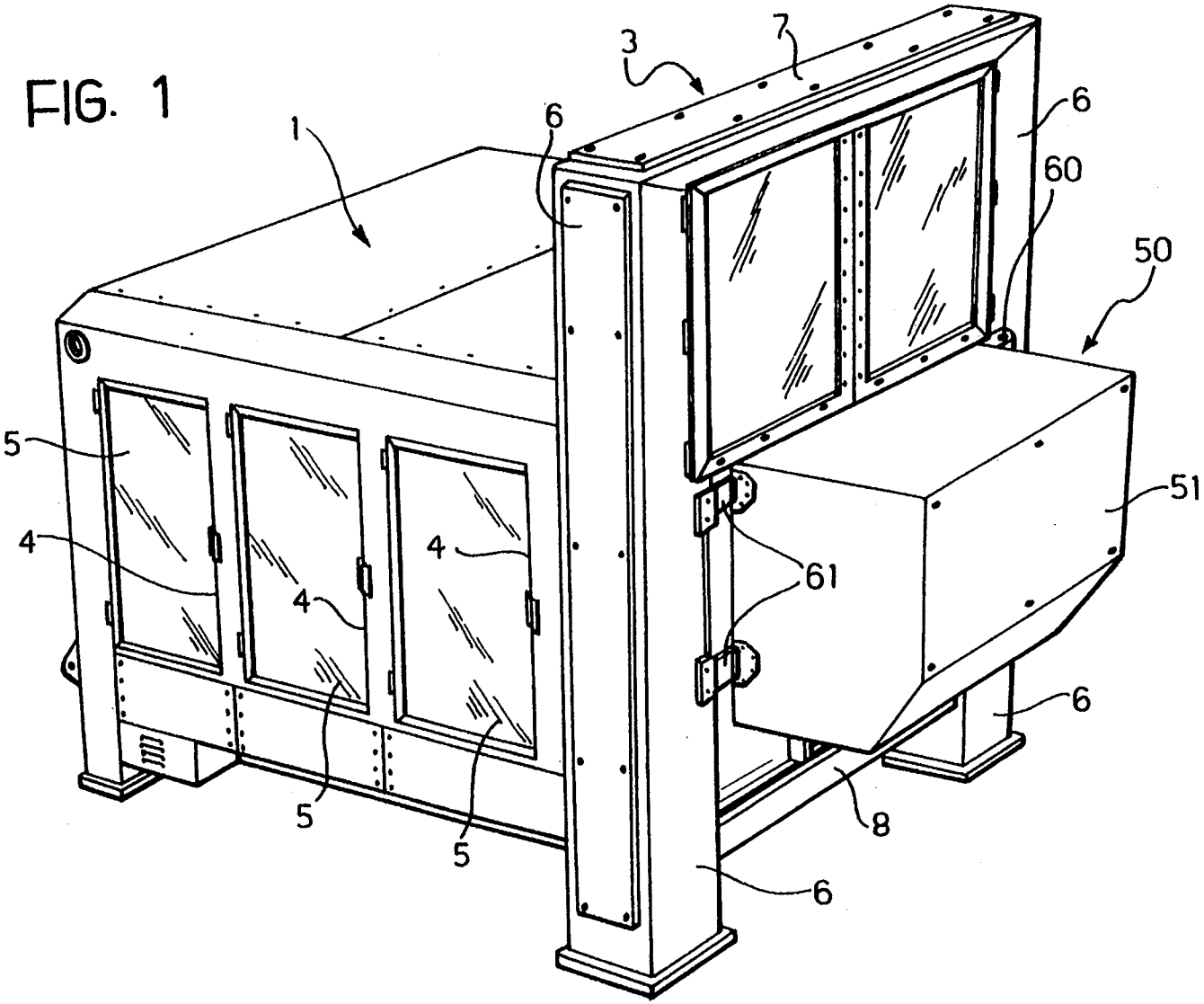
FIG. 1 is a perspective view of a slicing machine according to the invention.

With reference to the drawings, a slicing machine according to the invention comprises a substantially tunnel-shaped support structure 1 with an inlet opening 2 (FIG. 2) and an outlet portal 3.

In the embodiment illustrated, at least one side wall of the tunnel-shaped support structure 1 has a plurality of holes or windows 4 with which respective transparent closure doors 5, for example, glazed doors, are associated.

The outlet portal 3 is defined by a pair of hollow vertical uprights 6 surmounted by a cross member 7.

Figure 5:
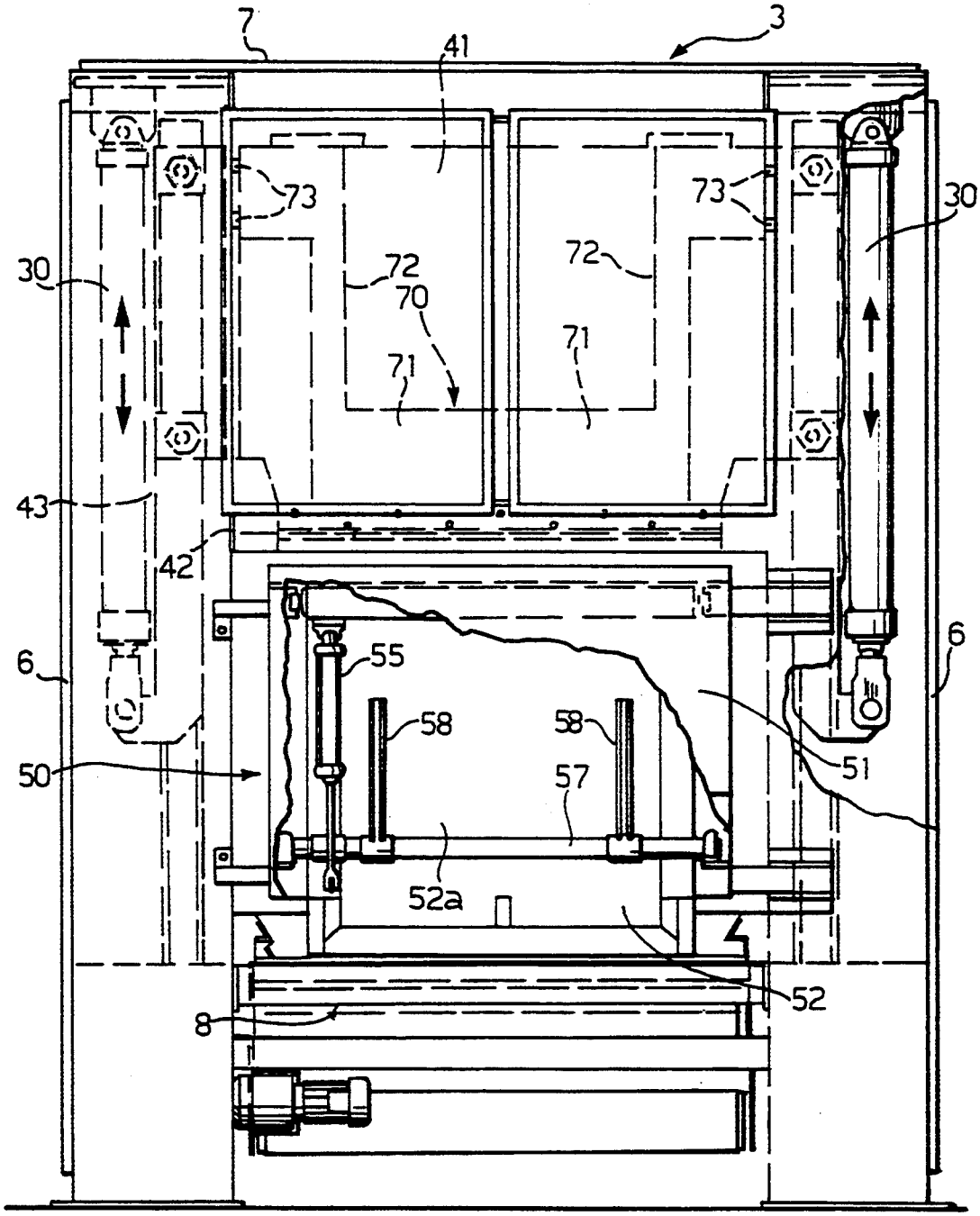
FIG. 5 is a front view of the slicing machine.

The lower ends of the uprights 6 are connected by a reinforcing cross member 8 (FIGS. 1 and 5).

The uprights 6 of the outlet portal 3 are somewhat taller than the top of the tunnel-shaped support structure 1.

Figure 2:
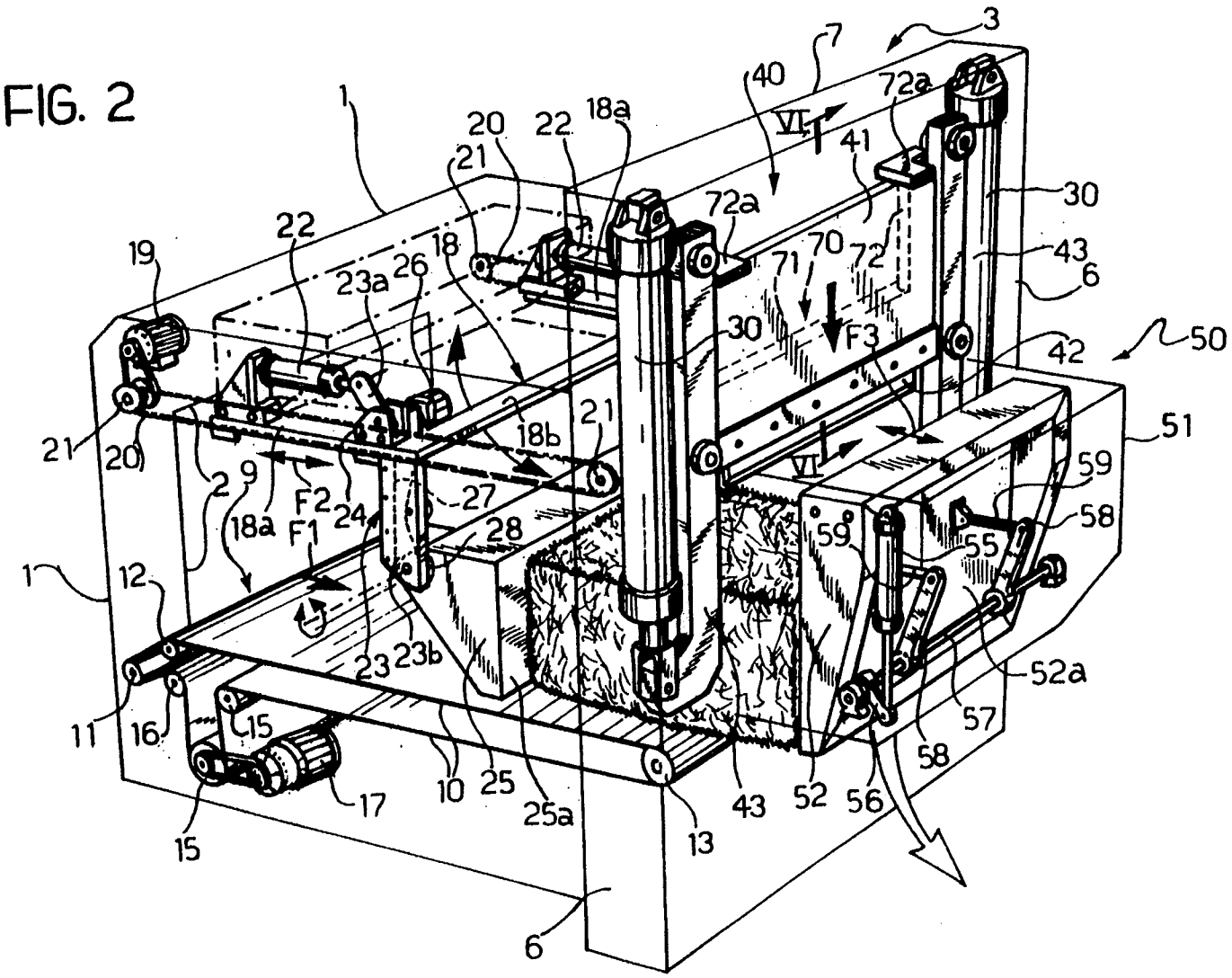
FIG. 2 is a perspective view of the machine of FIG. 1, showing—transparently—the internal mechanisms thereof.

In the bottom of said tunnel-shaped structure there is a belt conveyor, generally indicated 9 in FIG. 2. This conveyor comprises an endless belt or piece of fabric 10 which is stretched between rollers 11 to 16 and is moved by an electric motor 17 fixed to the support structure 1. In use, the activation of the motor moves the fabric or belt 10 so that its upper pass moves from the inlet opening of the support structure 2 towards the outlet portal 3, as indicated by the arrow F1 in FIG. 2.

A carriage 18 is movable in the tunnel-shaped structure 1 above the belt conveyor 9 and, in the embodiment shown (FIG. 2), comprises two lateral arms **18*a* joined together by a cross member 18*b*. This carriage is movable within the support structure 1 between the inlet opening 2 and the portal 3, parallel to the conveyor belt 9, by the operation of a drive system which comprises an electric motor 19 and associated transmission chains 20 extending between sprockets 21**.

Respective drive cylinders 22 are connected to the lateral arms **18*a* of the carriage 18. The rod of each cylinder is articulated to a first end 23*a* of an arm 23 which can pivot relative to the carriage in a vertical plane parallel to the direction of movement of said carriage, about a pin 24**.

A thrust member **25*a* is articulated between the other ends 23*b* of the arms 23 and extends transverse the direction of movement of the carriage 18. In the embodiment illustrated, the thrust member is essentially prismatic in shape and has a flat thrust surface, indicated 25*a* in FIGS. 2 to 4**.

A further electric motor carried by a lateral arm **18*a* of the carriage 18 is indicated 26 in FIG. 2 and, by means of a transmission chain 27 (FIGS. 2 and 4), can rotate a sprocket 28 which is fixed to the thrust member 25 and is coaxial with the axis of articulation of the latter to the ends 23*b* of the pivoting arms 23**.

Figure 3:
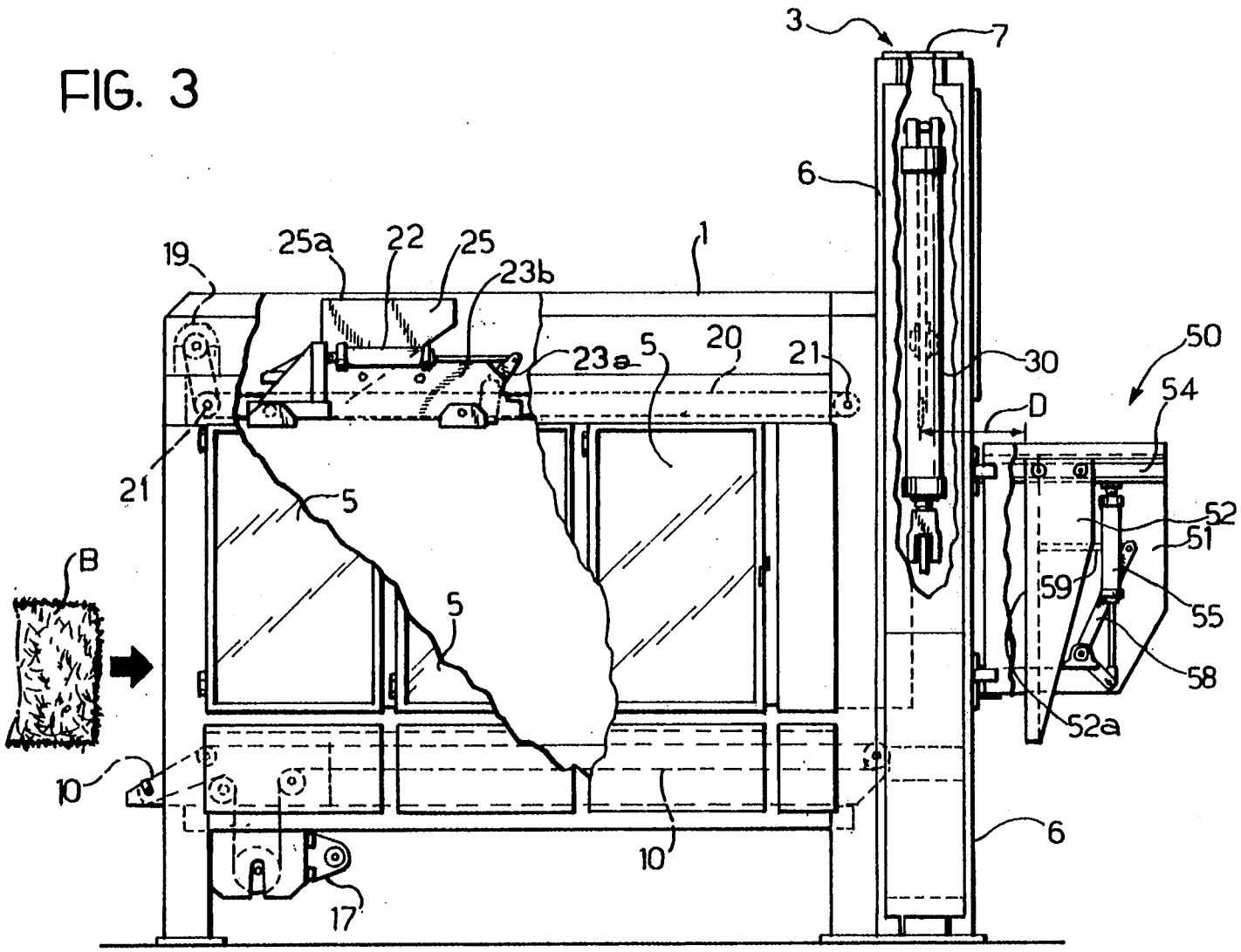
FIGS. 3 and 4 are partially-sectioned side views of the slicing machine in two different working conditions.
Figure 4:
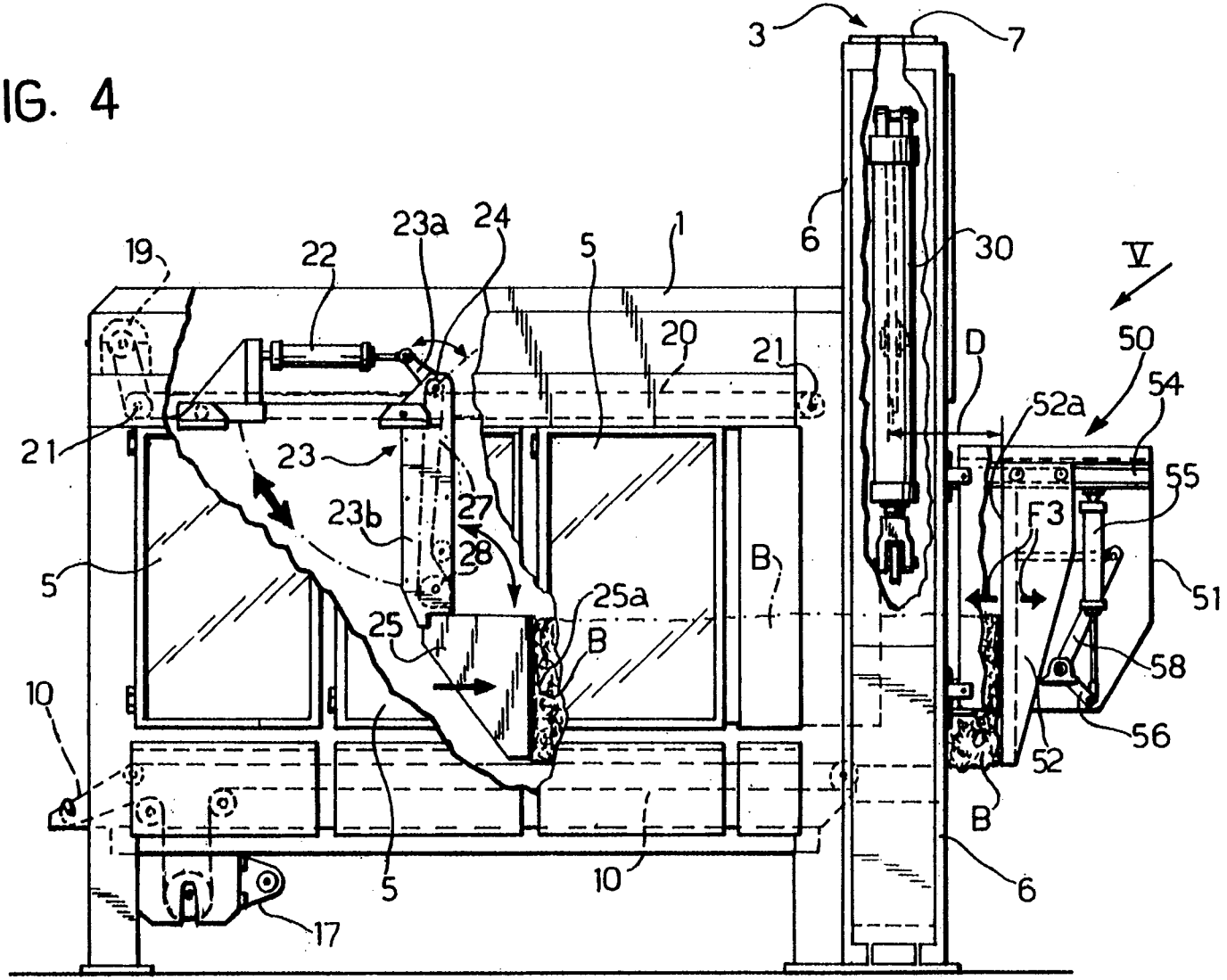

In operation, the coordinated operation of the cylinders 22 and of the electric motor 26 moves the pivoting arms 23 and the thrust member 25 from the raised position of FIG. 3 to the lowered position shown in FIGS. 2 and 4.

In the raised position (FIG. 3), the portions **23*b* of the pivoting arms 23 extend parallel to and adjacent the lateral arms 18*a* of the carriage 18 and the thrust member 25 extends above the plane of the carriage with its thrust surface 25*a*** facing upwardly.

In the lowered position (FIGS. 2 and 4), the portions **23*b* of the pivoting arms 23 extend downwardly beneath the general plane of the carriage 18 towards the conveyor belt 10 and the thrust member 25 extends a short distance from the conveyor belt 10 and is oriented with its thrust surface 25*a* parallel to and facing the outlet portal 3**.

The thrust member 25 can be moved from the position of FIG. 3 to the position of FIG. 4 by the pivoting of the arms 23 (by means of the cylinders 22) in combination with a simultaneous pivoting of the thrust member 25 about its axis of articulation to said arms (brought about by the operation of the electric motor 26).

Two strong drive cylinders, indicated 30 in FIGS. 2 to 5, are fixed in the upper portions of the uprights 6 of the outlet portal 3.

The lower ends of said rods of these cylinders are connected to a guillotine-like cutting device, generally indicated 40 in FIG. 2. This device comprises a plate 41 the bottom of which is connected to a cutting blade 42. The vertical sides of the plate 41 are connected to two arms 43, the lower ends of which are connected to the rods of the cylinders 30.

The plate 41 and the associated cutting blade 42 can be moved by means of the cylinders 30 between the raised position shown in FIGS. 2 to 5 and a lowered, cutting position (not shown).

A compressor device associated with the unit formed by the plate 41 and the cutting blade 42 is generally indicated 70 in FIGS. 2, 5, 6 and 7. This device comprises a horizontal transverse pressure member 71, the ends of which are connected to the lower portions of two vertical arms 72, the outer sides of the top portions of which carry guide rollers 73 (FIGS. 5 to 7) which can run in vertical guides 74 (FIGS. 6 and 7) carried by the uprights 6 of the portal 3.

The upper ends of the arms 72 have respective bent tabs 72*a* (FIGS. 2, 6 and 7) for bearing on the upper edge of the plate 41.

Figure 7:
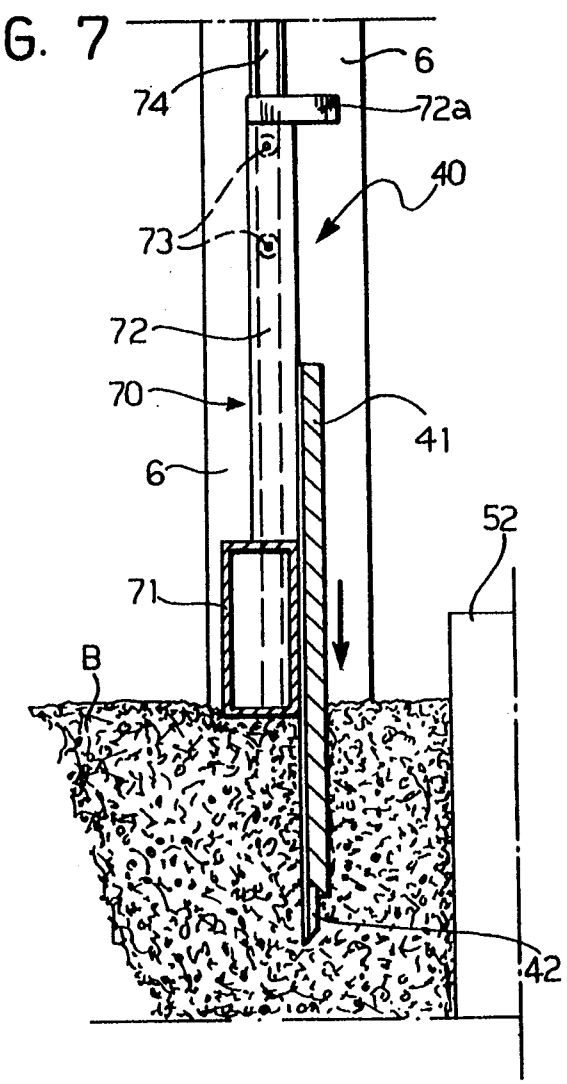
FIGS. 6 and 7 are partially-sectioned side views showing the guillotine-like cutting device in two different operating conditions.
Figure 6:
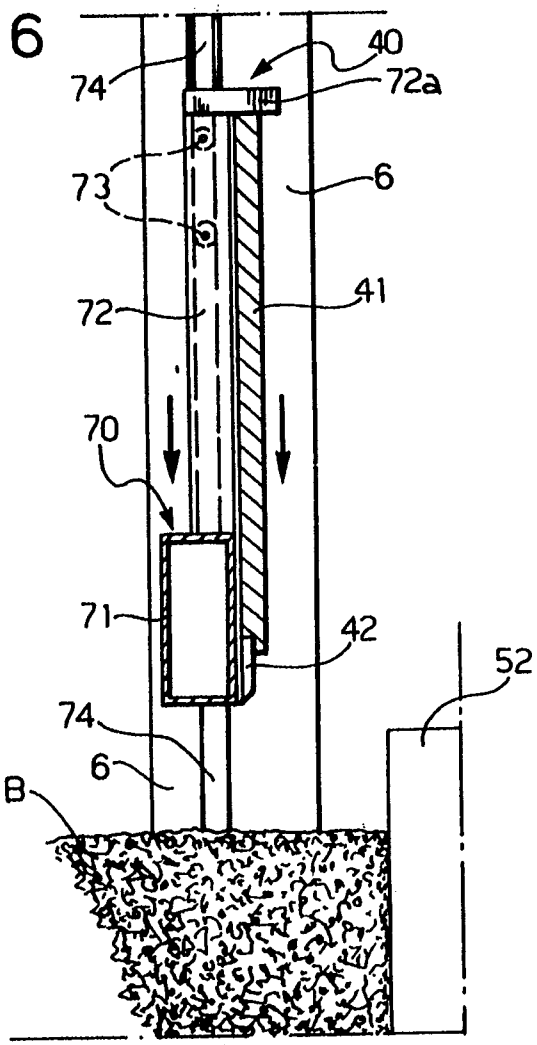

The compressor device 70 is disposed immediately upstream of the plate 41 and the associated blade 42 and can move vertically, together with said plate 41, as a result of the operation of the cylinders 30. This device is not fixed to said plate, however, so that it can, in fact, be entrained upwardly by this plate when the plate is raised by the cylinders 30 and fall by gravity when said plate is lowered, until it bears on and compresses an underlying bale of tobacco B extending through the portal 3 whilst the plate 41 and the blade 42, which are entrained further downwards by the cylinders 30, penetrate the bale (FIG. 7).

An abutment device connected to the outlet portal 3 downstream of the guillotine-like cutting device 40 is generally indicated 50 in the drawings. This abutment device comprises a substantially tank-like casing 51 disposed with its opening facing inwardly of the tunnel-shaped support structure 1.

A stop member 52, movable in the casing 51, has a front wall 52*a* which is oriented vertically and faces inwardly of the tunnel-shaped structure 1.

This stop member is movable away from and towards the guillotine-like cutting device in the directions indicated by the arrows F3 in FIGS. 2 and 4, along guide rails 54 (FIGS. 3 and 4) in the casing 51.

In the embodiment shown, the stop member 52 can be moved by means of a drive cylinder 55 the top of which is articulated to the casing 51 and the rod of which is articulated to an operating arm 56 of a kinematic mechanism connected to the member 52. This kinematic mechanism comprises a shaft 57 (FIG. 2) which can rotate in the casing 51 and to which the arm 56, as well as two further arms or cranks 58 connected to the member 52 by means of respective articulated connecting rods 59, are fixed torsionally.

The slicing machine described above operates in the following manner.

A bale of tobacco, indicated B in FIGS. 3 and 4, is introduced into the tunnel-shaped structure 1 through its inlet opening 2 as indicated in FIG. 3. This bale may be introduced manually or may be supplied to the slicing machine, for example, by means of conveyor devices, not shown.

In this condition, the machine assumes the configuration shown in FIG. 3, in which the thrust member 25 is in the raised position and does not obstruct the transfer of the bale B towards the outlet portal 3 by the conveyor belt 10. The plate 41 and the associated cutting blade 42 are in the raised position, so that the bale B is carried through the portal 3 by the belt 10 until it stops against the stop surface 52*a* of the abutment device 50 as shown in FIG. 4.

The coordinated operation of the cylinders 22 and of the electric motor 26 associated with the carriage 18 then move the thrust member 25 towards the lowered position shown in FIG. 4. The operation of the electric motor 19 also moves the carriage 18 towards the outlet portal until the thrust surface 25*a* of the member 25 is brought to bear against the rear end face of the bale B. At this point, the activation of the cylinders 30 causes a downward movement of the cutting blade 42 and of the compressor device 70 which, by means of its transverse pressure member 71, compacts the bale, which is then penetrated by said blade. The slice between the path of this blade and the stop surface 52*a* of the stop member 52 is thus cut.

The blade 42 and the associated plate 41 are then returned to the raised position by means of the cylinders 30. This plate entrains the compressor device 70 and raises it again. The coordinated operation of the electric motor 19 and the drive cylinder 55 then moves the thrust member 25 towards the portal 3 and retracts the stop member 52 within the casing 51 until the slice previously cut is free to fall downwards by gravity where conveyor devices may be provided for collecting it and moving it away from the slicing machine.

The stop member 52 of the abutment device 50 is then advanced towards the portal 3 again until it reaches its working position at a distance D from the path of the cutting blade 42, this distance corresponding to the thickness of the slices into which the bale B is to be divided.

The bale B is brought against the surface 52*a* of the stop member 52 again as a result of a further movement of the thrust member 25 towards the outlet portal 3.

The cutting blade 42 is then lowered again in order to cut another slice. The operation proceeds in the manner described above until the tobacco bale B has been used up, after which the slicing machine is returned to its initial configuration and the operation recommences with the supply of a further bale of tobacco through its inlet portal 2.

Conveniently, in order to facilitate inspection and any maintenance or repairs of the guillotine-like cutting device, the support casing 51 of the abutment device 50 is connected to one of the uprights 6 of the portal 3 by means of hinges 60 (FIG. 1) which enable it to pivot in a horizontal plane after the release of locking means 61 which connect it releasably to the other upright of the portal.

The coordinated operation of the various electric motors and of the various operating cylinders of the machine may be achieved in known manner by means of a control unit, not shown.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A machine for slicing bales of tobacco, comprising:

a support structure having an inlet opening for the insertion of a bale, and an outlet portal, a conveyor for transferring the bale from said inlet opening to the outlet portal, a guillotine-like cutting device in said outlet portal, the cutting device comprising a cutting blade which is movable between a raised position in which it allows the bale carried by the conveyor to pass through the outlet portal and a lowered, cutting position, a thrust device movable in said structure, above the conveyor, the thrust device comprising a thrust member which is positionable to bear against a rear end surface of the bale carried by the conveyor so as to urge the bale towards and through the outlet portal in a controlled manner, and an abutment device associated with the outlet portal, downstream of the cutting device, the abutment device comprising a movable stop member which assumes a working position in which the movable stop member defines a position where the bale advancing through the outlet portal in use is stopped at a predetermined distance from the path of the cutting blade, the distance corresponding to the desired thickness of the slices to be cut, and wherein said thrust device comprises a motor-driven carriage disposed above said conveyor and movable away from and toward the outlet portal, at least one arm articulated to the carriage and pivotable in a vertical plane parallel to the direction of movement of the carriage, said thrust member extending transverse the direction of movement of the carriage and being connected to said at least one arm, and a first motor which is carried by the carriage and pivots said at least one arm between a raised, rest position in which the thrust member extends above the path of the bale carried by the conveyor and a lowered, working position in which the thrust member bears against the rear end surface of the bale carried by said conveyor.

2. A slicing machine according to claim 1, wherein said thrust member is articulated to said at least one arm for pivoting about a horizontal axis perpendicular to the direction of movement of the carriage, and wherein a second motor on the carriage pivots the thrust member about said axis.

3. A slicing machine according to claim 1, wherein said abutment device comprises:

a support casing connected to said outlet portal, and a stop member motor for moving the stop member away from and towards the path of the cutting blade.

4. A slicing machine according to claim 3, wherein the support casing of the abutment device is connected pivotably to the outlet portal.

5. A slicing machine according to claim 1, wherein a compressor device is associated with said guillotine-like cutting device and compacts the bale of tobacco adjacent the path of said cutting blade.

6. A slicing machine according to claim 5, wherein said compressor device comprises a pressure member which is coupled to the cutting blade in a manner such that the pressure member falls by gravity from a raised position when said blade is lowered and raises again by being entrained by said blade when the blade is raised.

7. A slicing machine according to claim 1, wherein said support structure is substantially tunnel-shaped and has at least one side wall which is at least partially transparent.

8. A slicing machine according to claim 7, at least one side wall of said tunnel-shaped support structure has openable inspection windows.

* * * * *